US011089820B2

(12) United States Patent
Liu

(10) Patent No.: US 11,089,820 B2
(45) Date of Patent: Aug. 17, 2021

(54) ELECTRONIC CIGARETTE COMPRISING SEALED ATOMIZING ASSEMBLY

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 291 days.

(21) Appl. No.: 16/240,785

(22) Filed: Jan. 6, 2019

(65) Prior Publication Data

US 2020/0113241 A1 Apr. 16, 2020

(30) Foreign Application Priority Data

| | | |
|---|---|---|
| Oct. 12, 2018 | (CN) | 201811191766.7 |
| Oct. 12, 2018 | (CN) | 201821658441.0 |
| Nov. 30, 2018 | (CN) | 201811452855.2 |
| Nov. 30, 2018 | (CN) | 201821997753.4 |

(51) Int. Cl.
*A24F 47/00* (2020.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 9,801,418 | B1 * | 10/2017 | Liu | A24F 40/90 |
| 10,251,423 | B2 * | 4/2019 | Mamoun | H05B 3/0014 |
| 10,276,898 | B2 * | 4/2019 | Leadley | H01M 10/443 |
| 2012/0204889 | A1 * | 8/2012 | Xiu | A24F 47/008 131/273 |
| 2012/0227752 | A1 * | 9/2012 | Alelov | A61M 15/0065 131/273 |
| 2014/0196716 | A1 * | 7/2014 | Liu | A24F 47/008 128/202.21 |
| 2015/0090278 | A1 * | 4/2015 | Schiff | A24F 47/008 131/328 |
| 2015/0128976 | A1 * | 5/2015 | Verleur | H02J 7/00 131/329 |
| 2015/0150305 | A1 * | 6/2015 | Shenkal | A61M 15/06 131/329 |
| 2015/0216236 | A1 * | 8/2015 | Bless | A24F 47/008 131/328 |
| 2015/0245658 | A1 * | 9/2015 | Worm | A24F 40/50 131/328 |
| 2015/0272210 | A1 * | 10/2015 | Liu | A24F 13/02 131/257 |

(Continued)

*Primary Examiner* — Abdullah A Riyami
*Assistant Examiner* — Marcus E Harcum
(74) *Attorney, Agent, or Firm* — Matthias Scholl P.C.; Matthias Scholl

(57) ABSTRACT

An electronic cigarette, including an atomizing assembly; and a battery assembly. The atomizing assembly is disposed on the battery assembly. The atomizing assembly includes a mouthpiece, a plug, an e-liquid storage tank, an atomizing core, a seal ring adapting to seal the atomizing core, and a first fixed seat adapting to fix the atomizing core. The atomizing core includes a first end and a second end. The seal ring is disposed on the first end of the atomizing core, and the first fixed seat sleeves the second end of the atomizing core. The e-liquid storage tank includes a cavity, and the seal ring, the atomizing core, and the first fixed seat are disposed in the cavity of the e-liquid storage tank. The plug is disposed on the e-liquid storage tank, and the mouthpiece is connected to the e-liquid storage tank.

1 Claim, 5 Drawing Sheets

(56) References Cited

U.S. PATENT DOCUMENTS

2015/0280273 A1* 10/2015 Liu ..... H01M 10/0525 429/164
2016/0183592 A1* 6/2016 Liu ..... H05B 1/0244 131/329
2017/0035115 A1* 2/2017 Monsees ..... A24B 15/167
2017/0042228 A1* 2/2017 Liu ..... A24F 47/008
2017/0231280 A1* 8/2017 Anton ..... A61M 15/06 392/404
2017/0311646 A1* 11/2017 Liu ..... A24F 40/40
2018/0020728 A1* 1/2018 Alarcon ..... G01F 1/6888 392/404
2018/0077967 A1* 3/2018 Hatton ..... A24F 47/008
2018/0140017 A1* 5/2018 Qiu ..... H05B 3/44
2018/0184710 A1* 7/2018 Tucker ..... A24F 47/008
2018/0184722 A1* 7/2018 Murison ..... A24F 47/008
2018/0272083 A1* 9/2018 Avots ..... A61M 11/048
2018/0310616 A1* 11/2018 Clemens ..... A24F 40/10
2018/0310627 A1* 11/2018 Qiu ..... A24F 47/008
2018/0338529 A1* 11/2018 Weigensberg ..... A61M 15/06
2019/0053544 A1* 2/2019 Yamada ..... A24F 47/00
2019/0090539 A1* 3/2019 Rostami ..... H02J 7/0045
2019/0104763 A1* 4/2019 Tucker ..... A24B 15/283
2019/0133190 A1* 5/2019 Chen ..... A24F 47/008
2019/0150516 A1* 5/2019 Shenkal ..... A61L 9/014
2019/0166913 A1* 6/2019 Trzecieski ..... A61M 15/06
2019/0166914 A1* 6/2019 Qiu ..... G01K 1/02
2019/0191768 A1* 6/2019 Qiu ..... H01M 2/1022
2019/0208824 A1* 7/2019 Wright ..... H01H 21/04
2019/0223501 A1* 7/2019 Ouyang ..... H01M 2/1055
2019/0307168 A1* 10/2019 Zhao ..... A24F 40/10
2019/0350256 A1* 11/2019 Hejazi ..... A24F 40/46
2019/0350259 A1* 11/2019 Ouyang ..... A24F 47/008
2019/0357592 A1* 11/2019 Zhu ..... A24F 40/46
2019/0380389 A1* 12/2019 Hong ..... A24F 40/95
2020/0000146 A1* 1/2020 Anderson ..... A24F 40/90
2020/0009336 A1* 1/2020 Feng ..... A61M 15/06
2020/0015524 A1* 1/2020 Rado ..... A24F 7/00
2020/0029619 A1* 1/2020 Sundberg ..... A24F 7/02
2020/0093181 A1* 3/2020 Hubbard ..... A24F 40/30
2020/0093184 A1* 3/2020 Crespo ..... H05B 1/0297
2020/0113243 A1* 4/2020 Novak, III ..... A24F 40/42
2020/0113244 A1* 4/2020 Novak, III ..... H01R 13/6205
2020/0113246 A1* 4/2020 Barbaric ..... A24F 40/53

* cited by examiner

ELECTRONIC CIGARETTE COMPRISING SEALED ATOMIZING ASSEMBLY

CROSS-REFERENCE TO RELAYED APPLICATIONS

Pursuant to 35 U.S.C. § 119 and the Paris Convention Treaty, this application claims foreign priority to Chinese Patent Application No. 201811191766.7 filed Oct. 12, 2018, to Chinese Patent Application No. 201821658441.0 filed Oct. 12, 2018, to Chinese Patent Application No. 201811452855.2 filed Nov. 30, 2018, and to Chinese Patent Application No. 201821997753.4 filed Nov. 30, 2018. The contents of all of the aforementioned applications, including any intervening amendments thereto, are incorporated herein by reference. Inquiries from the public to applicants or assignees concerning this document or the related applications should be directed to: Matthias Scholl PC., Attn.: Dr. Matthias Scholl Esq., 245 First Street, 18th Floor, Cambridge, Mass. 02142.

BACKGROUND

This disclosure relates to an electronic cigarette.

Electronic cigarettes atomize e-liquid and generate nicotine-containing vapor.

Conventionally, the atomizing assembly fixedly communicates with the e-liquid storage tank. This increases the risk of leakage of the e-liquid.

SUMMARY

The disclosure provides an electronic cigarette comprising an atomizing assembly and an e-liquid storage tank. When the electronic cigarette is not in use, the atomizing assembly is separated from the e-liquid storage tank.

Provided is an electronic cigarette, comprising an atomizing assembly; and a battery assembly. The atomizing assembly is disposed on the battery assembly.

The atomizing assembly comprises a mouthpiece, a plug, an e-liquid storage tank, an atomizing core, a seal ring adapting to seal the atomizing core, and a first fixed seat adapting to fix the atomizing core. The atomizing core comprises a first end and a second end. The seal ring is disposed on the first end of the atomizing core, and the first fixed seat sleeves the second end of the atomizing core. The e-liquid storage tank comprises a cavity, and the seal ring, the atomizing core, and the first fixed seat are disposed in the cavity of the e-liquid storage tank. The plug is disposed on the e-liquid storage tank, and the mouthpiece is connected to the e-liquid storage tank.

The battery assembly comprises a support, a first gasket adapting to sealing the support, a button board, a second gasket adapting to sealing the button board, a housing, a light guide, a second fixed seat adapting to fixing the light guide, a keypad, a silicone sleeve, a battery cell, a charging board, a first fixing bolt adapting to fix the charging board, a base, and a second fixing bolt adapting to fix the base. The support comprises a top end and a side wall disposed on the top end. The first gasket and the second gasket are disposed outside and inside the side wall of the support, respectively. The button board comprises a button and the silicone sleeve sleeves the button. The charging board is connected to the battery cell, and the charging board and the battery cell are welded to the button board. The button board is disposed on the support. The charging board is riveted on the support via the first fixing bolt. The keypad is fixed on the support. The light guide is disposed on the second fixed seat. The second fixed seat is disposed in the housing. The base is mounted on a bottom end of the support, and the support is disposed in the housing; and the base is riveted on a bottom end of the housing via the second fixing bolt.

Advantages of the electronic cigarette according to embodiments of the disclosure are summarized as follows. When not in use, the e-liquid inlet of the atomizing core is completely sealed in the first fixed seat and is separated from the e-liquid storage tank. Thus, the e-liquid cannot enter the atomizing core. When in use, the atomizing assembly is mounted on the battery assembly, under the action of external force, the support pushes the atomizing core to move towards the mouthpiece, so that the e-liquid inlet of the atomizing core is exposed and communicates with the e-liquid storage tank. Thus, the e-liquid flows into the atomizing core via the inlet. The atomizing assembly is clamped in and combined with the housing 9 of the battery assembly to form the electronic cigarette. Thus, the electronic cigarette has a relatively small size, is lightweight, easy to assemble and carry. The atomizing assembly can be replaced easily.

DETAILED DESCRIPTION

To further illustrate, embodiments detailing an electronic cigarette are described below. It should be noted that the following embodiments are intended to describe and not to limit the disclosure.

Figure 1:
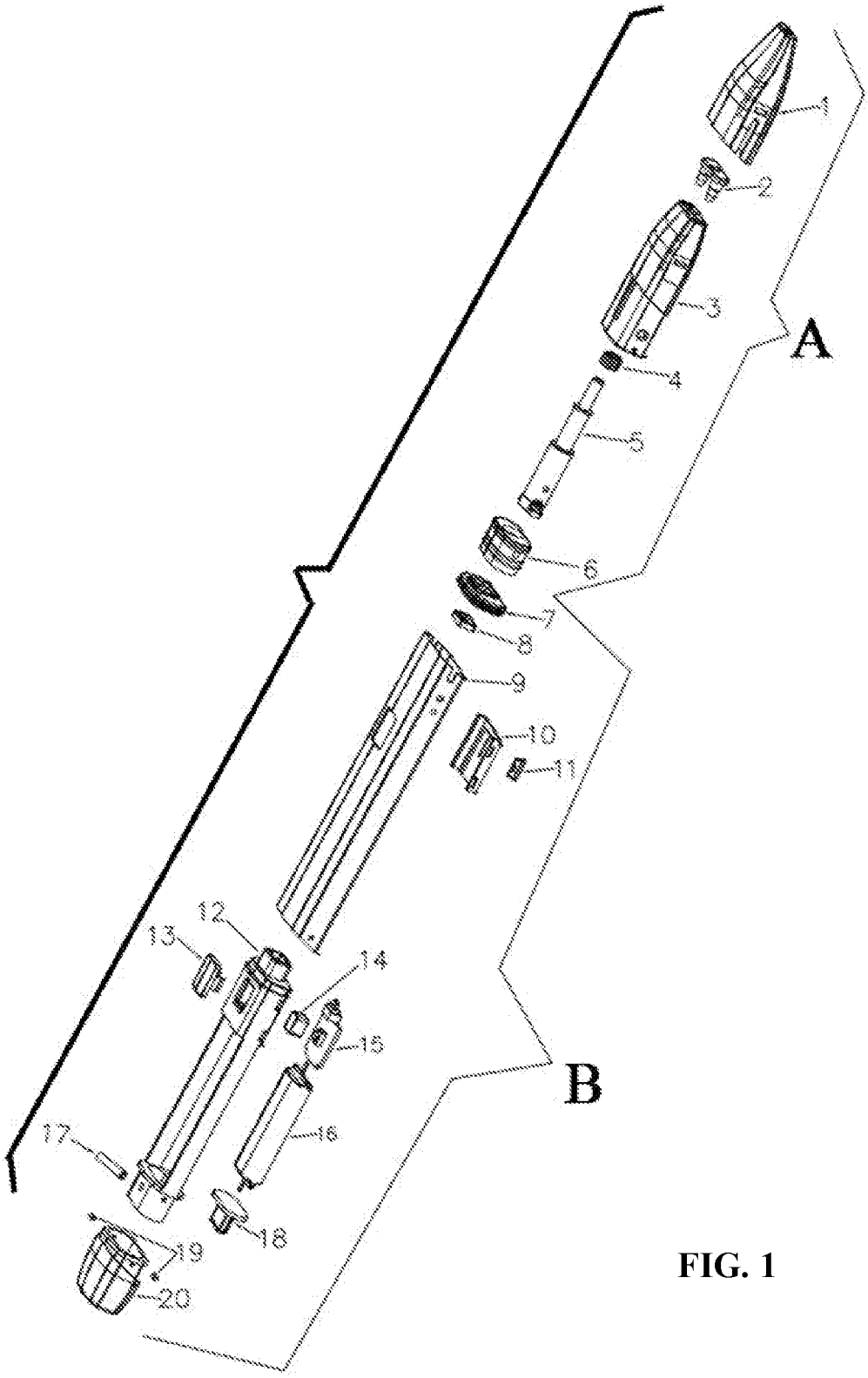
FIG. 1 is an exploded view of an electronic cigarette as described in the disclosure.
Figure 2:
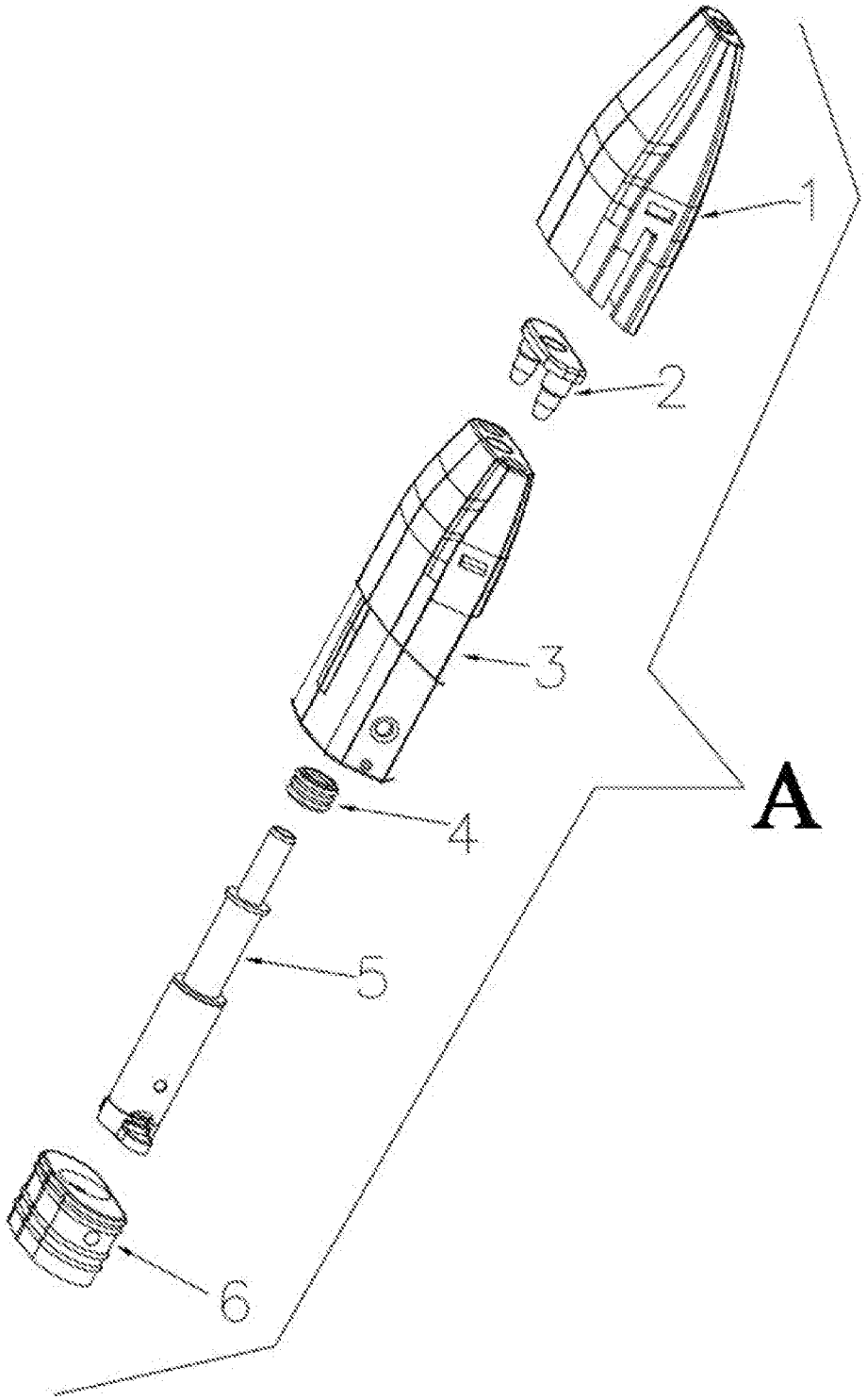
FIG. 2 is an exploded view of an atomizing assembly of an electronic cigarette as described in the disclosure.
Figure 3:
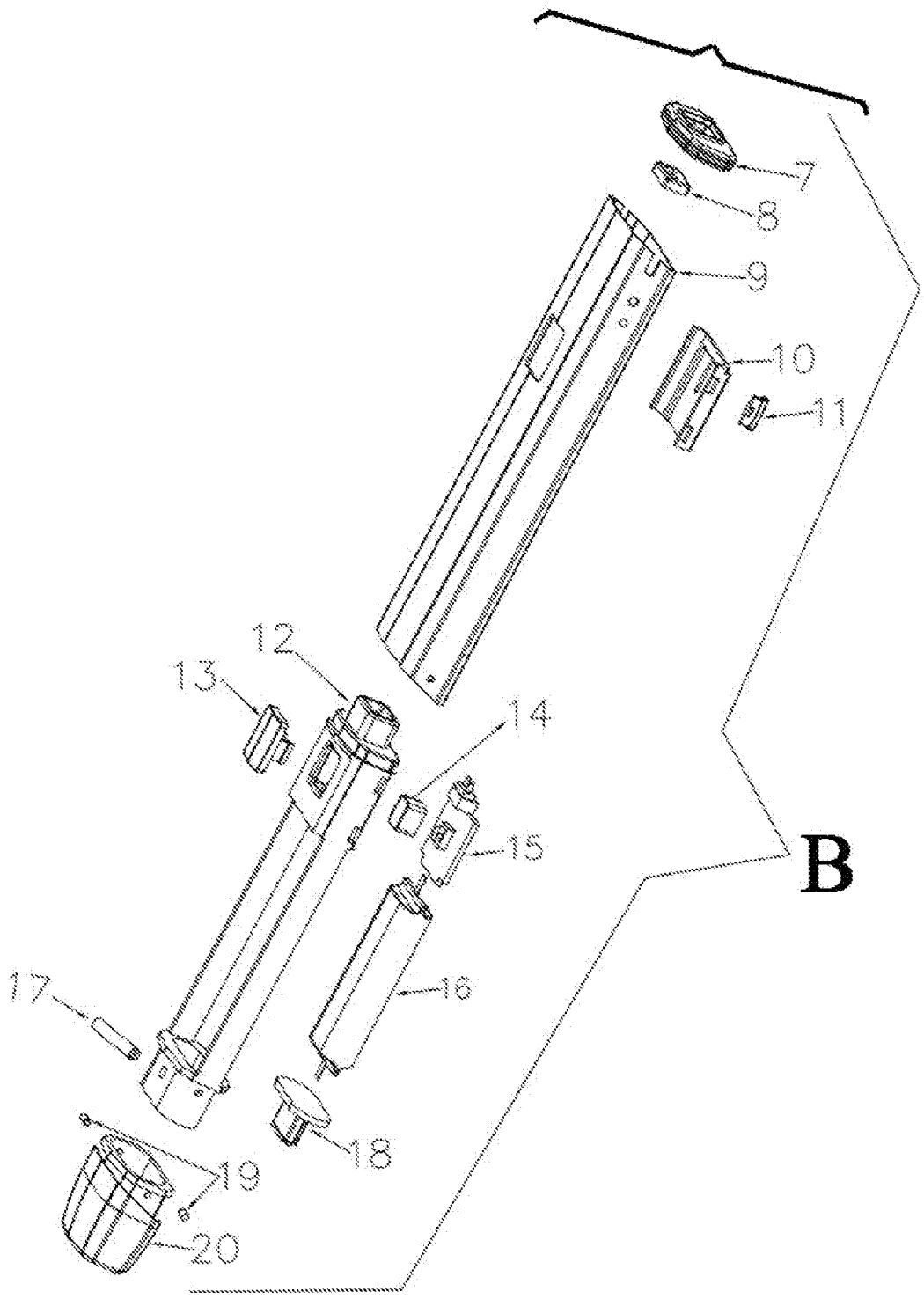
FIG. 3 is an exploded view of a battery assembly of an electronic cigarette as described in the disclosure.
Figure 4:
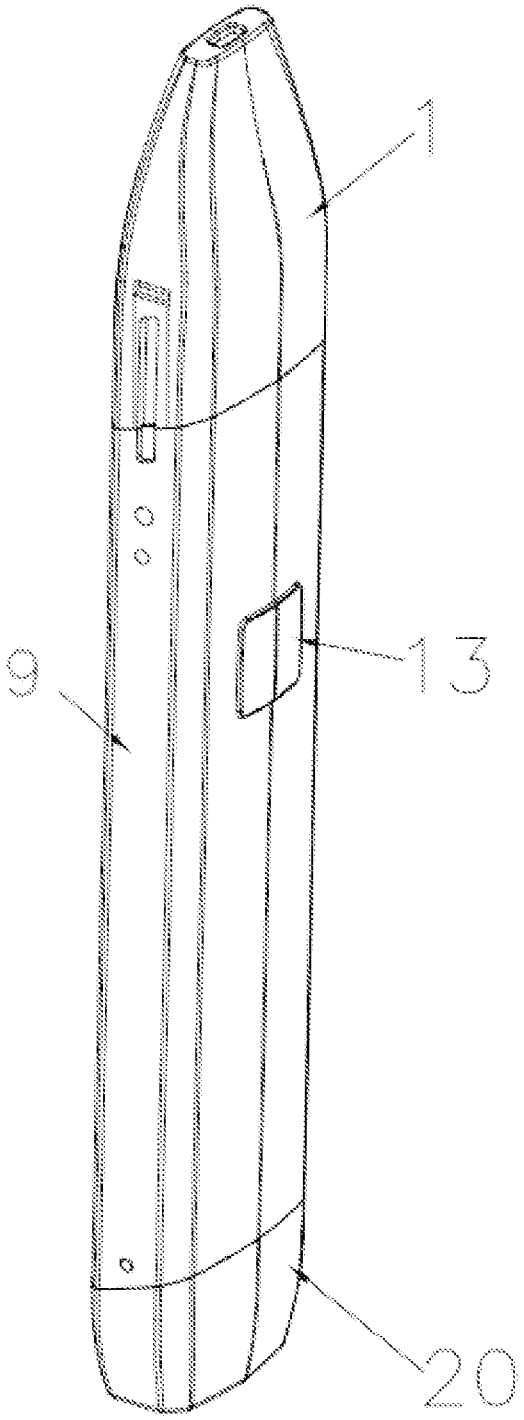
FIG. 4 is a stereogram of an electronic cigarette as described in the disclosure.
Figure 5:
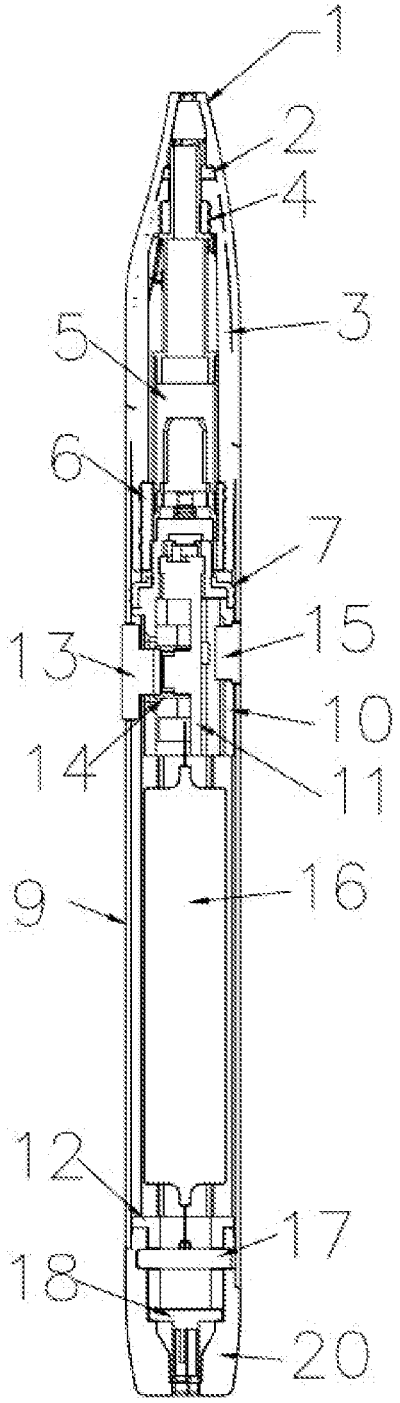
FIG. 5 is a sectional view of an electronic cigarette as described in the disclosure.

As shown in FIGS. 1-5, an electronic cigarette comprises an atomizing assembly A and a battery assembly B. The atomizing assembly A is disposed on the battery assembly B. The atomizing assembly A comprises a mouthpiece 1, a plug 2, an e-liquid storage tank 3, an atomizing core 5, a seal ring 4 adapting to seal the atomizing core 5, and a first fixed seat 6 adapting to fix the atomizing core 5. The atomizing core 5 comprises a first end and a second end. The seal ring 4 is disposed on the first end of the atomizing core 5, and the first fixed seat 6 sleeves the second end of the atomizing core 5. The e-liquid storage tank 3 comprises a cavity, and the seal ring 4, the atomizing core 5, and the first fixed seat 6 are disposed in the cavity of the e-liquid storage tank 3. The plug 2 is disposed on the e-liquid storage tank 3. Thus, the two ends of the e-liquid storage tank 3 are tightly sealed. The mouthpiece 1 is connected to the e-liquid storage tank 3.

The battery assembly B comprises a support 12, a first gasket 7 adapting to sealing the support 12, a button board 15, a second gasket 8 adapting to sealing the button board 15, a housing 9, a light guide 11, a second fixed seat 10 adapting to fixing the light guide 11, a keypad 13, a silicone sleeve 14, a battery cell 16, a charging board 18, a first fixing bolt 17 adapting to fix the charging board 18, a base 20, and a second fixing bolt 19 adapting to fix the base 20. The support 12 comprises a top end and a side wall disposed on the top end. The first gasket 7 and the second gasket 8 are disposed outside and inside the side wall of the support 12, respectively, thus achieving the effect of isolation and insulation. The button board 15 comprises a button and the silicone sleeve 14 sleeves the button. The charging board 18 is connected to the battery cell 16, and the charging board 18 and the battery cell 16 are welded to the button board 15. The button board 15 is disposed on the support 12. The charging board 18 is riveted on the support 12 via the first fixing bolt 17. The keypad 13 is fixed on the support 12. The light guide 11 is disposed on the second fixed seat 10. The second fixed seat 10 is disposed in the housing 9. The base 20 is mounted on a bottom end of the support 12, and the support 12 is disposed in the housing 9; and the base 20 is riveted on a bottom end of the housing 9 via the second fixing bolt 19.

Before the atomizing assembly is mounted on the battery assembly, the e-liquid inlet of the atomizing core 5 is completely sealed in the first fixed seat 6 and is separated from the e-liquid storage tank 3. Thus, the e-liquid cannot enter the atomizing core 5. When the atomizing assembly is mounted on the battery assembly, under the action of external force, the support 12 pushes the atomizing core 5 to move upwards (towards the mouthpiece), so that the e-liquid inlet of the atomizing core 5 is exposed and communicates with the e-liquid storage tank 3. Thus, the e-liquid flows into the atomizing core 5 via the inlet. The atomizing assembly is clamped in and combined with the housing 9 of the battery assembly to form the electronic cigarette. Thus, the electronic cigarette has a relatively small size, is lightweight, easy to assemble and carry. The atomizing assembly can be replaced easily.

It will be obvious to those skilled in the art that changes and modifications may be made, and therefore, the aim in the appended claims is to cover all such changes and modifications.

What is claimed is:

1. An electronic cigarette, comprising:

an atomizing assembly; and a battery assembly;

wherein:

the atomizing assembly is adapted to be disposed on the battery assembly;

the atomizing assembly comprises a mouthpiece, a plug, an e-liquid storage tank, an atomizing core, a seal ring adapting to seal the atomizing core, and a first fixed seat adapting to support the atomizing core;

the atomizing core comprises a first end and a second end; the seal ring is disposed on the first end of the atomizing core, and the first fixed seat encompasses the second end of the atomizing core; the e-liquid storage tank comprises a cavity for containing e-liquid, and the seal ring, the atomizing core, and the first fixed seat are disposed in the cavity of the e-liquid storage tank; the plug is disposed on the e-liquid storage tank, and the mouthpiece is connected to the e-liquid storage tank;

the battery assembly comprises a support, a first gasket adapting to sealing the support, a button board, a second gasket adapting to sealing the button board, a housing, a light guide, a second fixed seat adapting to fixing the light guide, a keypad, a silicone sleeve, a battery cell, a charging board, a first fixing bolt adapting to fix the charging board, a base, and a second fixing bolt adapting to fix the base;

the support comprises a top end and a side wall disposed on the top end; the first gasket and the second gasket are disposed outside and inside the side wall of the support, respectively; the button board comprises a button and the silicone sleeve sleeves the button; the charging board is connected to the battery cell; the button board is disposed on the support; the charging board is riveted on the support via the first fixing bolt; the keypad is fixed on the support; the light guide is disposed on the second fixed seat; the second fixed seat is disposed in the housing; the base is mounted on a bottom end of the support, and the support is disposed in the housing; and the base is riveted on a bottom end of the housing via the second fixing bolt;

the atomizing core comprises an e-liquid inlet, the e-liquid inlet is disposed on the second end and is adapted to convey the e-liquid from the cavity to the atomizing core;

the atomizing core is movably disposed in the first fixed seat whereby the e-liquid inlet is disposed in or out of the first fixed seat;

when the atomizing assembly is separated from the battery assembly, the e-liquid inlet is disposed in and sealed by the first fixed seat, thereby the e-liquid inlet does not communicate with the cavity; and when the atomizing assembly is disposed on the battery assembly, the support of the battery assembly is disposed in the first fixed seat to move the atomizing core toward the mouthpiece, and the e-liquid inlet is disposed out of the first fixed seat, thereby the e-liquid inlet communicates with the cavity.

* * * * *